US007798785B2

(12) United States Patent
Tseng

(10) Patent No.: US 7,798,785 B2
(45) Date of Patent: Sep. 21, 2010

(54) AUTOMATIC PRESSURE-RELIEVING APPARATUS FOR SUCTION PUMP

(75) Inventor: Tien-Tsai Tseng, Wufong Township, Taichung County (TW)

(73) Assignee: Chuan Jiing Enterprises Co., Ltd., Taichung County (TW)

( * ) Notice: Subject to any disclaimer, the term of this patent is extended or adjusted under 35 U.S.C. 154(b) by 859 days.

(21) Appl. No.: 11/713,711

(22) Filed: Mar. 5, 2007

(65) Prior Publication Data

US 2008/0219859 A1 Sep. 11, 2008

(51) Int. Cl.
*F04F 3/00* (2006.01)
*F16K 31/18* (2006.01)
*B67C 3/16* (2006.01)

(52) U.S. Cl. ..... 417/148; 417/120; 417/126; 137/205; 137/434

(58) Field of Classification Search ..... 417/118, 417/120, 126, 130, 131, 134, 148; 137/202, 137/205, 434–451
See application file for complete search history.

(56) References Cited

U.S. PATENT DOCUMENTS 4,741,358 A * 5/1988 Cho ..... 137/426
4,909,274 A * 3/1990 Rodriguez ..... 137/312
5,450,924 A * 9/1995 Tseng ..... 184/1.5
6,722,855 B2 * 4/2004 Tien-Tsai ..... 417/199.1
7,219,686 B2 * 5/2007 Schmitz et al. ..... 137/413

* cited by examiner

*Primary Examiner*—Charles G Freay
(74) *Attorney, Agent, or Firm*—Rosenberg, Klein & Lee

(57) ABSTRACT

An automatic pressure-relieving apparatus for a suction pump comprises a pipework provided at the cap. A first rod positioned in the pipework has an upper sealing ring arranged around the top periphery thereof, whereby the first rod can detachably seal the upper opening of the pipework. Moreover, the first rod is coupled with a second rod, which is pierced through the lower opening of the pipework and extending into the oil reservoir of the cylinder. The second rod further has a sealing component arranged at the periphery thereof for moving. upward and detachably sealing the lower opening of the pipework. Also, a control device is fastened to the bottom of the second rod so that when the raising oil surface lifts a float of the control device, the float can in turn drive the first and second rods to move upward. Thereby, the upper and lower openings of the pipework are opened and closed respectively, and the pressure in the pump can be automatically released through the opened upper opening.

12 Claims, 10 Drawing Sheets

AUTOMATIC PRESSURE-RELIEVING APPARATUS FOR SUCTION PUMP

BACKGROUND OF THE INVENTION

1. Technical Field

The present invention relates to an automatic pressure-relieving apparatus for a suction pump and, more particularly, to a device that functions for relieving the vacuum state inside a suction pump being filled with oil.

2. Description of Related Art

FIG. 10 provides a schematic cross sectional view of a conventional suction pump. To operate such conventional suction pump, a user can pull a pull rod 60 to exhaust air in the cylinder 61 of the suction pump through an air channel 62 and a piston tube 63, whereby while the air in an oil reservoir 611 thereof is exhausted out gradually, suction can be generated in virtue of the nearly vacuum state in the oil reservoir. At this time, by an oil pipe 64 that communicates the oil reservoir 611 and external oil to be collected, said suction helps draw the external oil into the oil reservoir 611 of the cylinder 61 gradually. When the oil reservoir 611 is about to be filled, a float 65 provided in the cylinder 61 is lifted by the raising oil surface and finally a sealing end 651 of the float 65 comes to block an opening 621 situated between the air channel 62 and the oil reservoir 611. Subsequently, when the pullrod 60 is pulled, air existing between the piston tube 63 and the air channel 62 can be almost entirely exhausted out and a near vacuum state can be consequently formed between the piston tube 63 and the air channel 62. Under such vacuum state, the sealing end 651 of the float 65 presses even closer onto the opening 621, and the pullrod 60 now becomes immovable. Thus, a user can be informed that the cylinder 61 is filled with oil and he can press a relief valve 66 manually to let external air enter the air channel 62, so as to release the vacuum state between the piston tube 63 and the air channel 62.

Foresaid conventional technique regarding prevention of oil overflowing problem and pressure-relieving operation depends on the user's estimation of whether the pullrod 60 can be further pulled and his manual operation of pressing the relief valve 66 to release pressure. However, in addition to the inconvenience caused by the manual pressure relieving operation, another problem of this method is that if the user continuously pulls the pullrod 60 under the vacuum state with excessive force, the inner components of the pump such as the sealing end 651 may be damaged; consequently, the contained oil may undesirably overflow into the air channel 62 and this in turn induces contamination.

Hence, for more convenient operation of a suction pump, a need exists for an apparatus that automatically conducts pressure-relieving operation when the pump is filled with oil.

SUMMARY OF THE INVENTION

The present invention has been accomplished under these circumstances in view. It is one objective of the present invention to provide an automatic pressure-relieving apparatus for a suction pump that can automatically conduct pressure-relieving operation when the pump is filled with oil. By communicating air inside and outside the suction pump, the vacuum state inside the pump can be released. Meantime, a user can be informed that the suction pump is filled with oil when the automatic pressure-relieving operation begins.

To achieve these and other objectives of the present invention, the automatic pressure-relieving apparatus comprises:

a cylinder having an oil reservoir arranged therein and a cap positioned on the top thereof, wherein the cap includes an air channel;

a relieving device, which is connected to the cap and in communication with the air channel;

a pipework, which is positioned in the cap and has a upper opening at the top end thereof adjacent to the exterior, a lower opening at the bottom end thereof adjacent to the oil reservoir, a cannular portion defined between the upper and lower openings, and a venthole provided at the periphery thereof, whereby, the oil reservoir can get communicated with the relieving device through the lower opening, the cannular portion, the venthole and the air channel successively;

a first rod settled in the cannular portion of the pipework that can move downward from the exterior to detachably seal the upper opening of the pipework;

a second rod pierced through the lower opening of the pipework, and the top end of the second rod is positioned under the first rod in the cannular portion, while the lower end of the second rod is positioned under the lower opening of the pipework; a sealing component is arranged at the periphery of the second rod positioned under the lower opening for moving upward and detachably sealing the lower opening of the pipework; and a control device provided in the oil reservoir and approximately connected to the bottom of the second rod for controlling the upward and downward movements of the first and second rods.

BRIEF DESCRIPTION OF THE DRAWINGS

The invention as well as a preferred mode of use, further objectives and advantages thereof, will best be understood by reference to the following detailed description of an illustrative embodiment when read in conjunction with the accompanying drawings, wherein.

DETAILED DESCRIPTION OF THE PREFERRED EMBODIMENT

Please refer to FIGS. 1 to 9 for a plurality of preferred embodiments of the present invention. It is to be noted that the recited embodiments are for the purpose of illustration and not intended to limit the present invention with the discussed structure.

Figure 1:
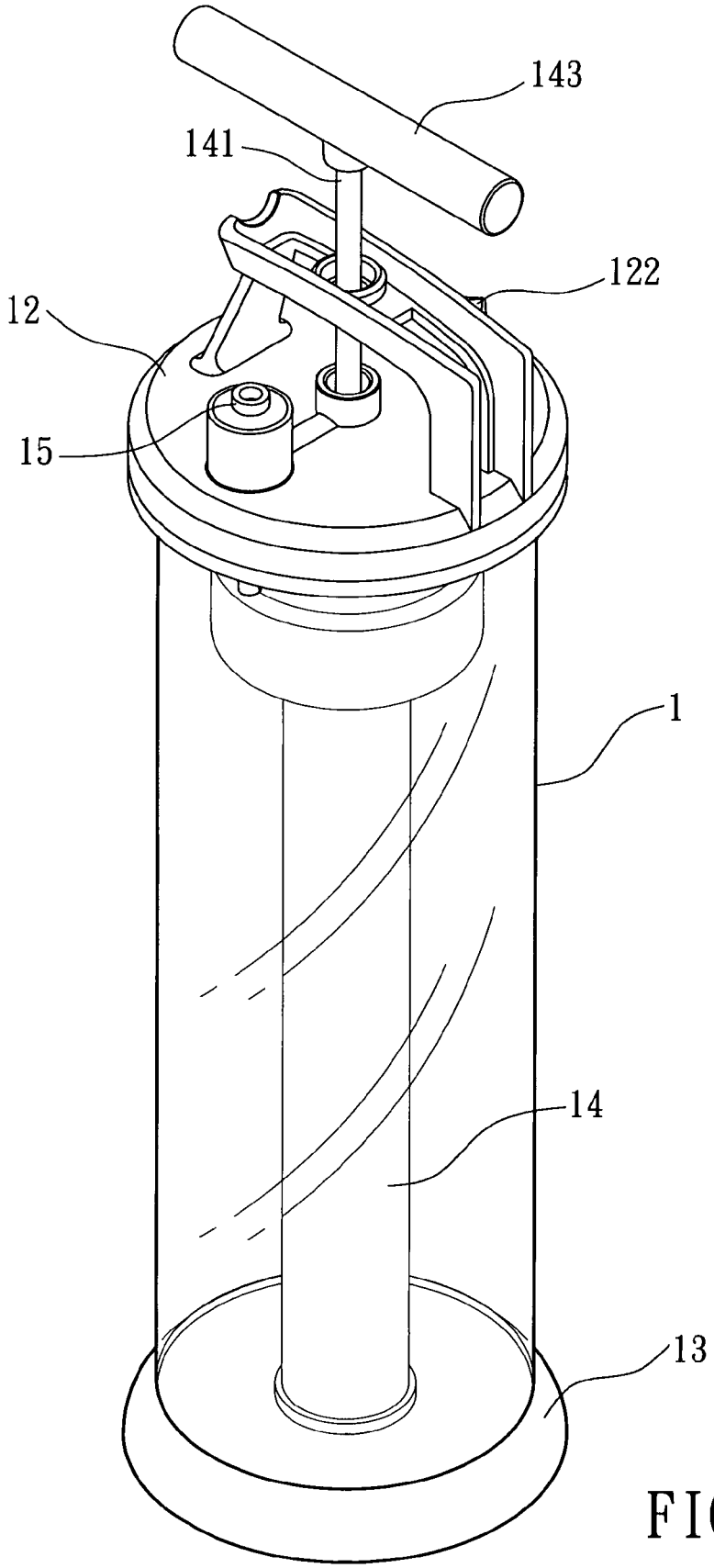
FIG. 1 is a perspective view of a suction pump equipped with the disclosed automatic pressure-relieving apparatus.
Figure 2:
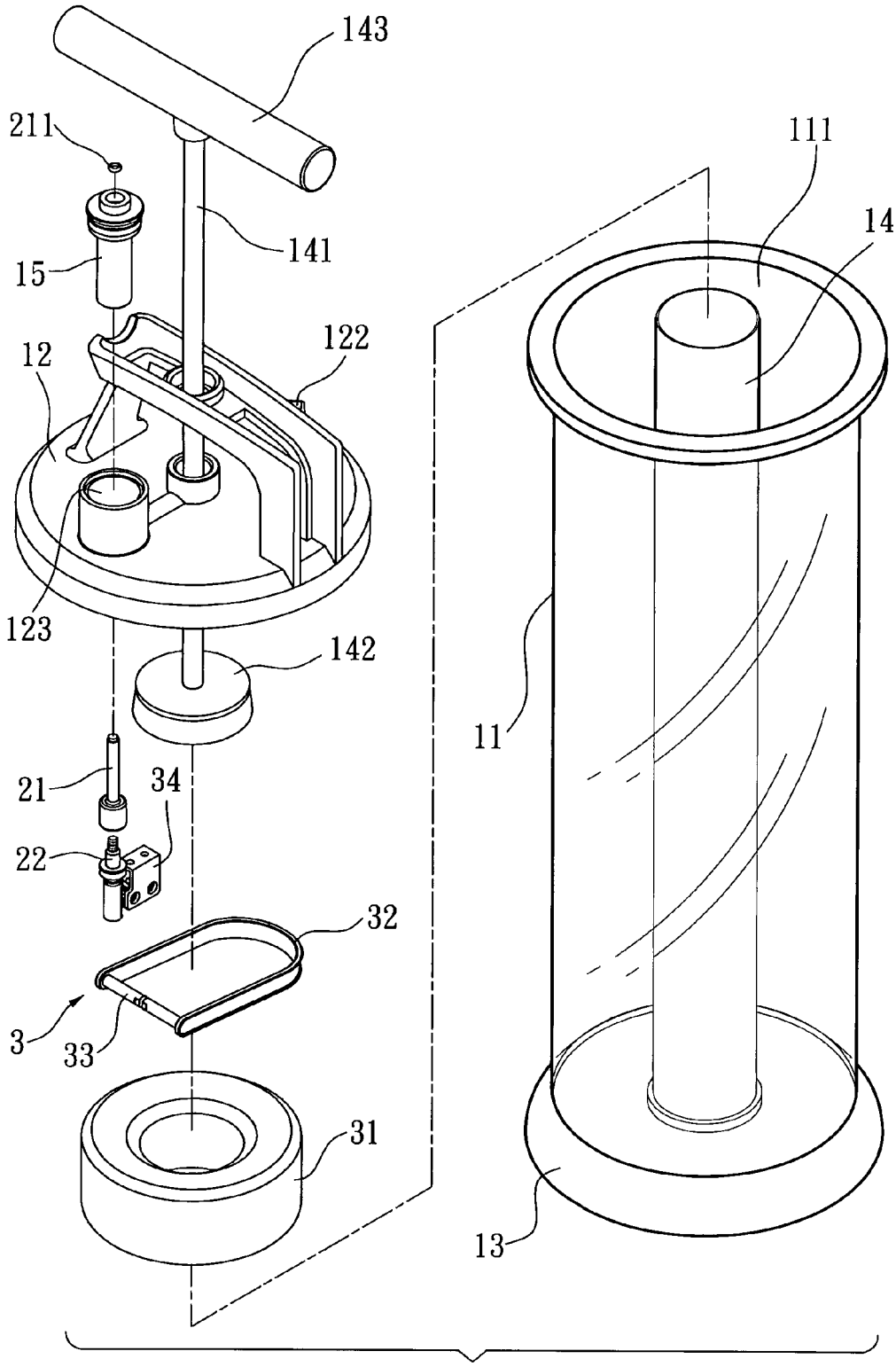
FIG. 2 is an exploded view of the suction pump of FIG. 1.
Figure 3:
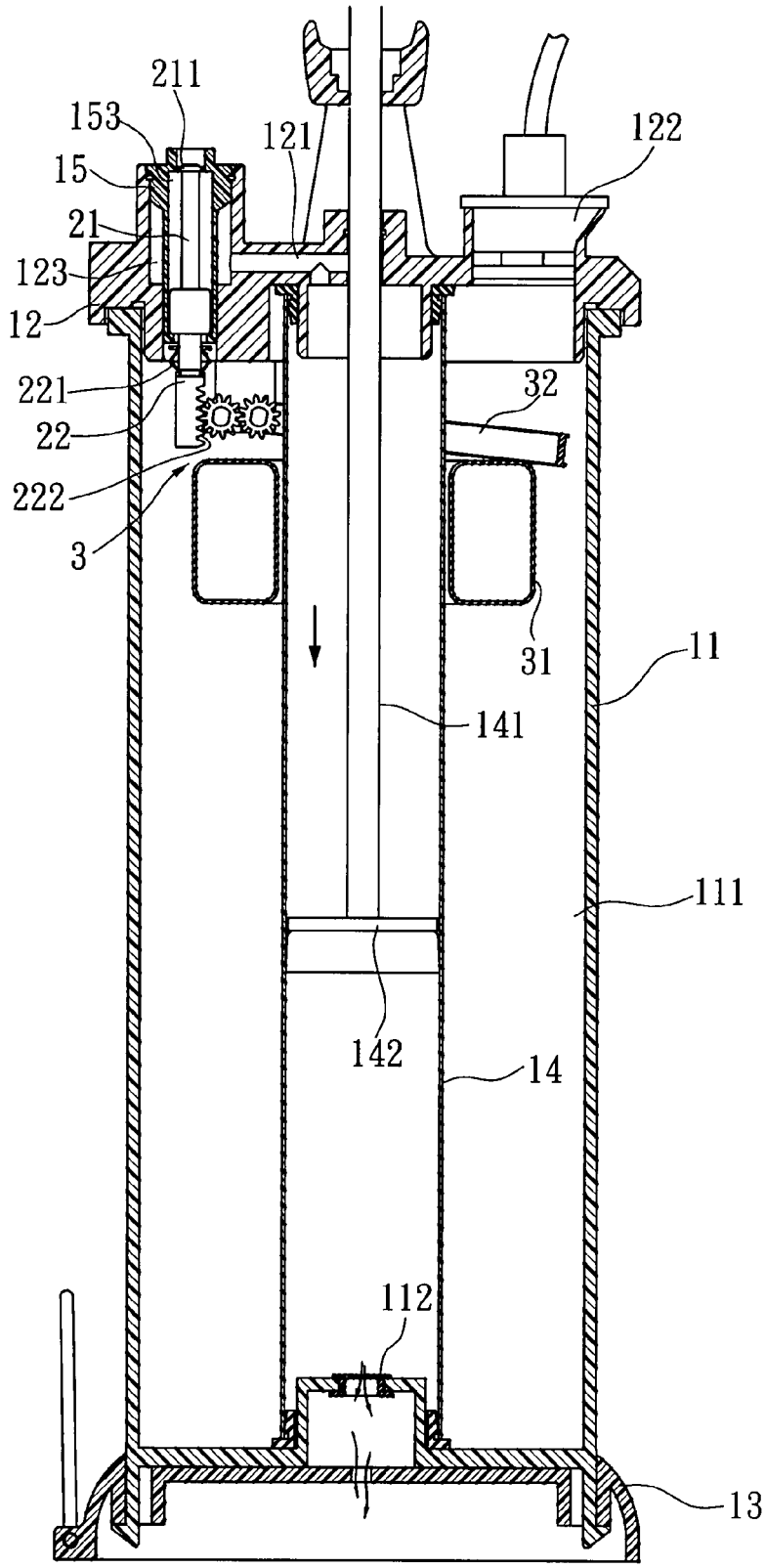
FIG. 3 is a schematic cross sectional view made according to FIG. 1 showing the piston moving along the piston tube and exhaust air downward.

Following is an interpretation of one preferred embodiment of the disclosed automatic pressure-relieving apparatus. In FIGS. 1 through 3, it can be seen that the disclosed subject matter possesses the structure as described below.

A cylinder 11 has an oil reservoir 111 enclosed therein and has a cap 12 positioned on the top thereof to seal the oil reservoir 111. The cap 12 includes an air channel 121 and a passage 123 that communicate the oil reservoir 111 with the exterior, wherein the passage 123 is in communication with the air channel 121. The cylinder 11 further includes a base 13 at the bottom thereof.

A relieving device is connected to the cap 12 and in communication with the air channel 121. According to the present embodiment, the relieving device may be a piston tube 14 arranged in the oil reservoir 111. The piston tube 14 is with its two opposite ends respectively fastened to the cap 12 and the bottom of the cylinder 11 and with the inner space thereof in communication with the air channel 121 of the cap 12.

Figure 4:
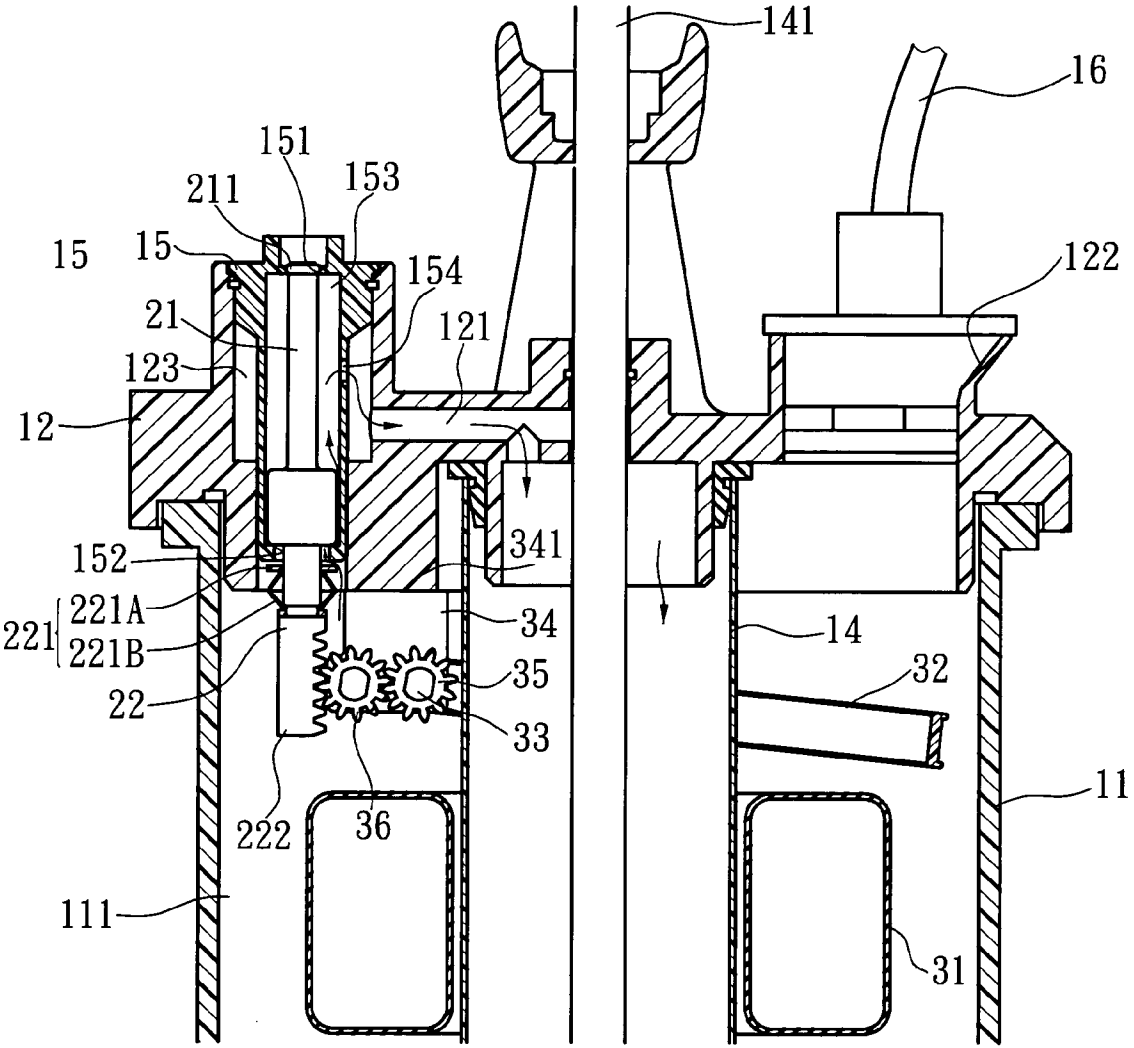
FIG. 4 is an enlarged cross sectional view of the cap showing the structure of the automatic pressure-relieving apparatus wherein the pullrod can be moved up and down.

Please refer to FIG. 2 and FIG. 4, the disclosed subject matter further comprises following components.

A pipework 15 positioned in the passage 123 of the cap 12 has a upper opening 151 at the top end thereof adjacent to the exterior, a lower opening 152 at the bottom end thereof adjacent to the oil reservoir 111, and a cannular portion 153 defined between the upper and lower openings 151, 152 of the pipework 15. A venthole 154 is provided at the periphery of the pipework 15 and in communication with the passage 123. Whereupon, the oil reservoir 111 can be communicated with the piston pipe 14 through the lower opening 152, the cannular portion 153, the venthole 154 and the air channel 121 successively.

A first rod 21 settled in the cannular portion 153 of the pipework 15 can move downward from the exterior to detachably seal the upper opening 151. According to the present embodiment, the first rod 21 further comprises an upper sealing ring 211 arranged around the top periphery thereof, whereby the first rod 21 can detachably seal the upper opening 151 of the pipework 15. Further, the upper opening 151 is tapered at the end adjacent to the cannular portion 153.

A second rod 22 is pierced through the lower opening 152 of the pipework 15 from the oil reservoir 111 and positioned in the cannular portion 153 under the bottom of the first rod 21. According to the present embodiment, the first and second rods 21, 22 are coaxially coupled in a screwed manner. The second rod 22 is with the bottom thereof positioned below the lower opening 152 of the pipework 15 and has a sealing component 221 arranged at the periphery thereof for moving upward and detachably sealing the lower opening 152 of the pipework 15.

In the present embodiment, the sealing component 221 comprises a sealing portion 221A and an elastic portion 221B, wherein the bottom of the elastic portion 221B closely surrounds the periphery of the second rod 22, and the elastic portion 221B is extending upward in a bent shape. The sealing portion 221A is deposited at the top of the elastic portion 221B adjacent to the lower opening 152 and can move up and down in virtue of the variation of the elastic portion 221 B.

A control device 3 is provided in the oil reservoir 111 and approximately connected to the bottom of the second rod 22 for controlling the upward and downward movements of the first and second rods 21, 22.

According to the present invention, the control device 3 comprises a float 31, a U-shaped driving member 32, a shaft 33, a connector 34, a driving gear 35 and a driven gear 36. The float 31 is settled in the oil reservoir 111 and positioned around the periphery of the piston tube 14 in the manner that the float 31 is movable with respect to the piston 14 along the axial direction thereof. The driving member 32 is deposited above the float 31 and surrounds the periphery of the piston tube 14. Further, the driving member 32 is fastened to the two opposite ends of the shaft 33 with its one side corresponding to the opening of the U shape, while the other side of the driving member 32 is pressing on one side of the top of the float 31. The shaft 33 is pierced through the driving gear 35 at its axis. The driving gear 35 is coupled and engaged with the driven gear 36. Further, the driving and driven gears 35, 36 are pivotally fastened to the connector 34 with the axes thereof respectively. One side of the top of the connector 34 is attached to the cap 12. The second rod 22 comprises a rack 222 provided adjacent to the bottom thereof. The rack 222 is positioned under the sealing component 221 for being engaged with the driven gear 36. Moreover, said connector 34 is fastened to the cap 12 by means of a screw 341.

Please refer to FIGS. 1 and 3, in the present embodiment, said piston tube 14 encloses a pull rod 141 and a one-way piston 142, wherein the piston 142 is positioned at one end of the pull rod 141 and the opposite end of the pull rod 141 is extending beyond the cap 12 to connect with a handle 143. A one-way valve 112 is situated within the piston tube 14 at the central bottom of the cylinder 11. An oil inlet 122 is arranged on the cap 12 for the passage of oil and the oil inlet 122 may be connected with an oil-pipe joint 16 for facilitating the drawing of oil.

Figure 5:
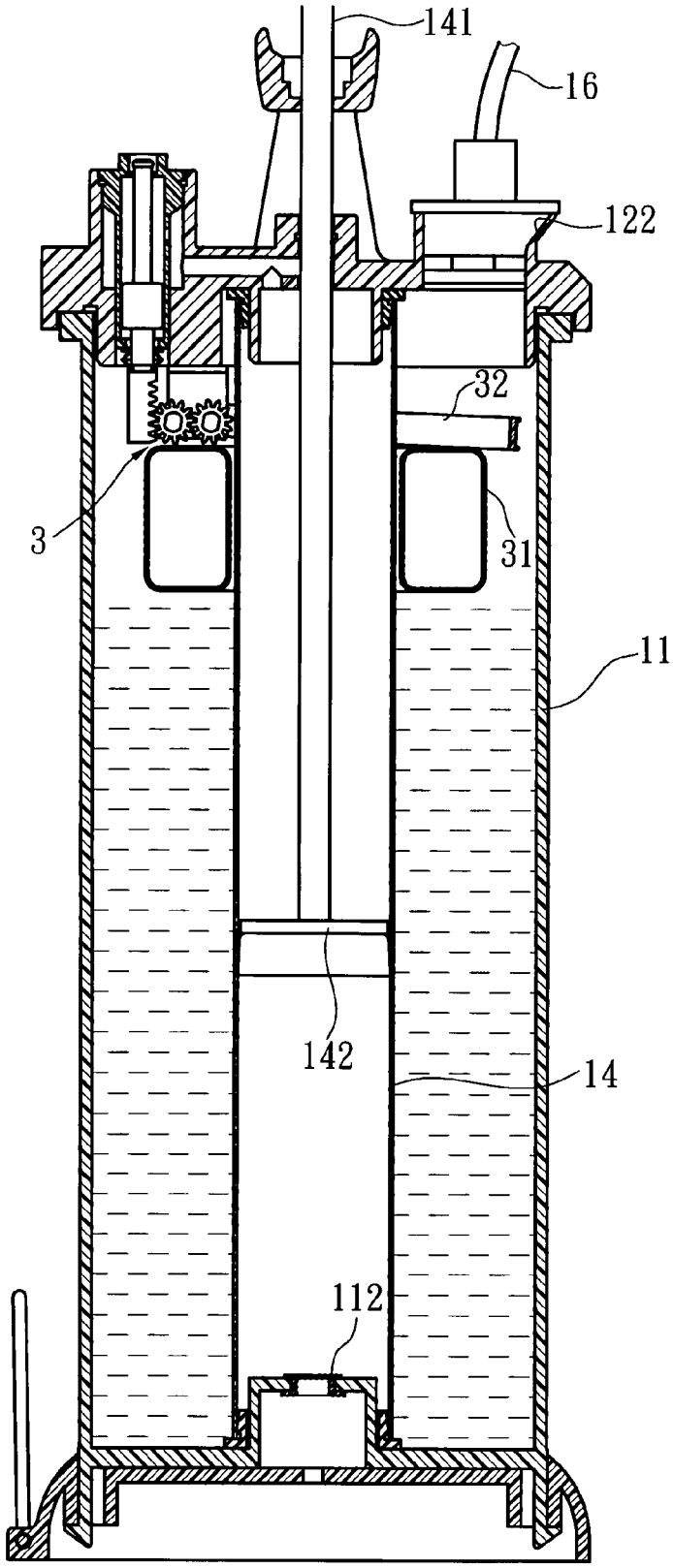
FIG. 5 is an applied view of the disclosed subject matter showing that when the cylinder is filled with oil, the lifted float drives the first and second rods to move upward and realize pressure-relieving operation.
Figure 6:
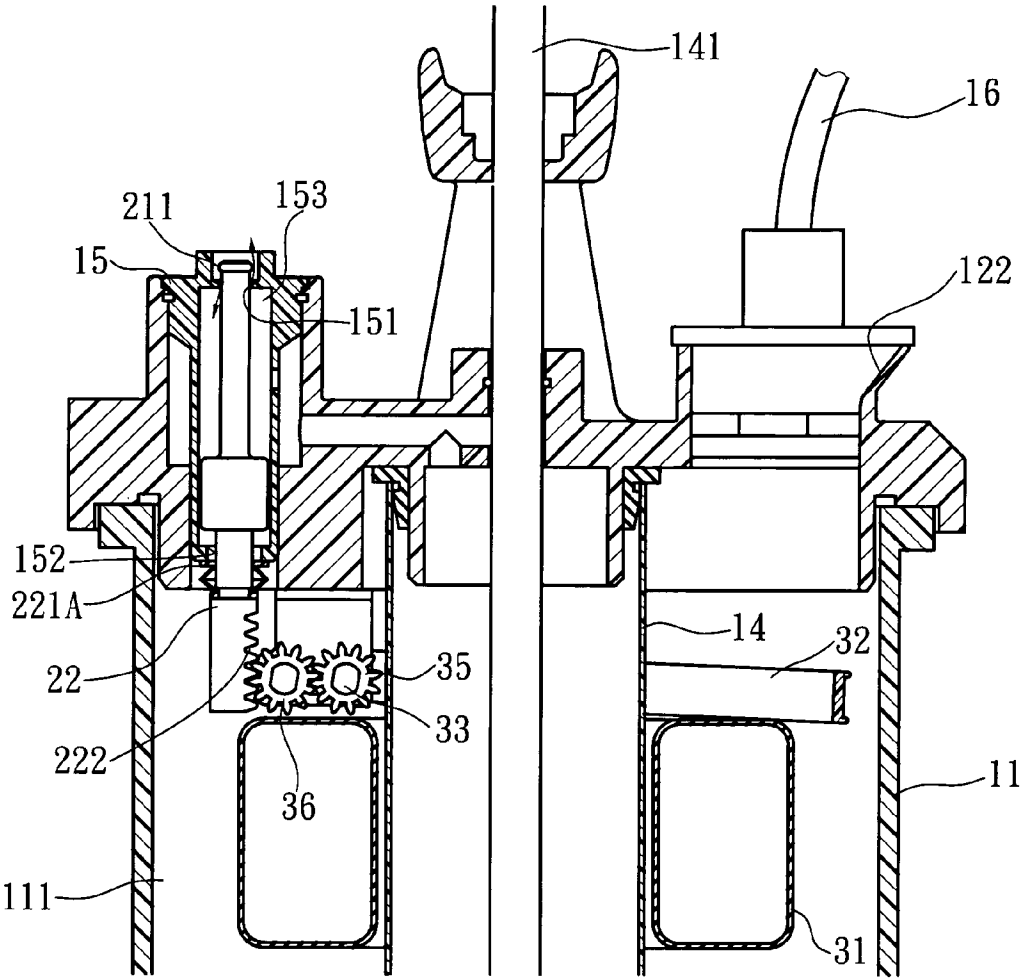
FIG. 6 is an enlarged cross sectional drawing according to FIG. 5.
Figure 7:
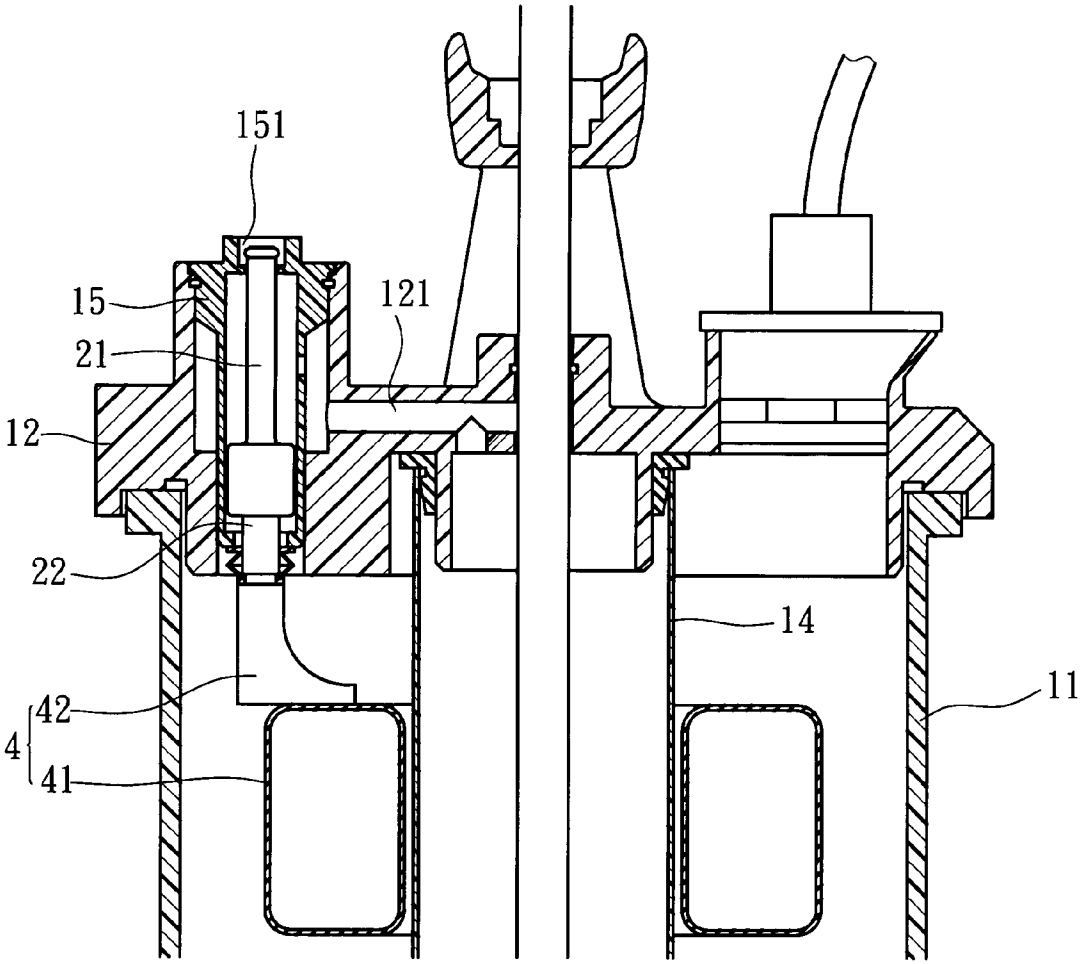
FIG. 7 is a schematic cross sectional view of the disclosed subject matter according to another embodiment of the present invention.
Figure 8:
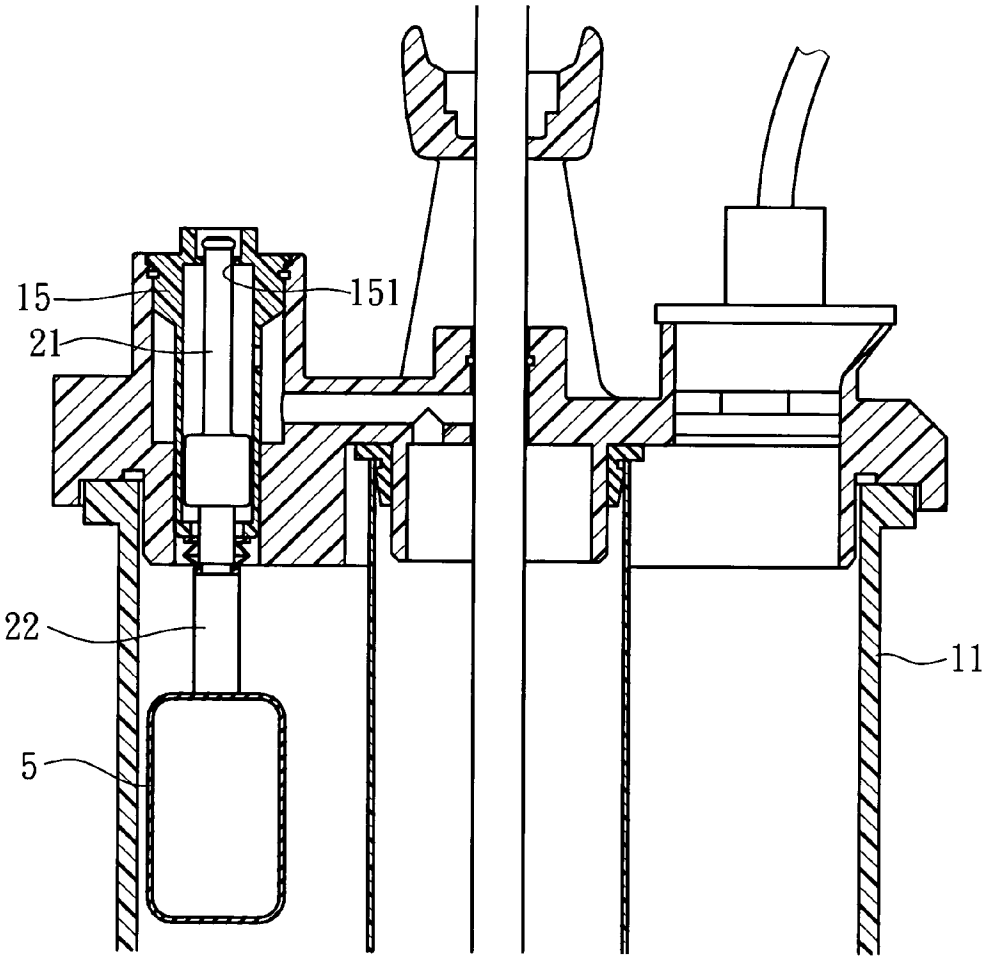
FIG. 8 is a schematic cross sectional view of the disclosed subject matter according to yet another embodiment of the present invention.

Following description is provided for illustrating the operation of the disclosed subject matter and is to be read in conjunction with FIGS. 4 through 6.

Before collecting oil, the first rod 21 and the second rod 22 are pulled down by the control device 3. At this time, the upper sealing ring 211 of the first rod 21 seals the upper opening 151 of the pipework 15, while the sealing portion 221A of the sealing component 221 of the second rod 22 does not press against the lower opening 152 of the pipework 15. Thus, the lower opening 152 is now opened.

During the process of drawing oil, the pull rod 141 is pulled up and down to allow the piston 142 to exhaust air in the piston tube 14 out by way of the one-way valve 112. Since the oil reservoir 111 is airtightly sealed, when the pull rod 14 is continuously pulled for exhausting air, air in the oil reservoir 111 can be sucked into the air channel 121 of the cap 12 by way of the lower opening 152, the cannular portion 153 and the venthole 154 successively of the pipework 15 and said air then enters the piston tube 14 again via the air channel 121. By the compressional movement of the piston 142 along the piston tube 14, air in the oil reservoir 111 can be continuously exhausted to the exterior and produce relative suction to draw external oil into the oil reservoir 111 of the cylinder 11 through the oil inlet 122.

As the oil is continuously collected and the oil surface rises to contact the float 31, the float 31 can be lifted gradually and pushes the driving member 32 located thereon upward. Thus, the driving member 32 can pivot upward on the shaft 33 to rotate the driving gear 35. Consequently, the driven gear 36 can be driven to rotate oppositely by the driving gear 35 where it is engaged. Thereby, the rack 222 of the second rod 22 can be in turn driven by the driven gear 36 where it is engaged, and thus pushing the first and second rods 21, 22 upward synchronously. Whereupon, the upper sealing ring 211 at the top of the first rod 21 moves upward and leaves from the upper opening 151 of the pipework 15 where it initially presses upon. Thus, the upper opening 151 can get communicated with the cannular portion 153. Meantime, the sealing portion 221A of the sealing component 221 provided on the second rod 22 comes to press against and seal the bottom of the lower opening 152 of the pipework 15. Whereupon, the oil reservoir 111 is isolated from the cannular portion 153 of the pipework 15, and the pressure of the remaining air suction can be leveled with the external pressure because the upper opening 151 of the pipework 15 is opened. Therefore, the oil stored in the oil reservoir 111 can be prevented from overflowing, which may be caused by continuous oil drawing under excessive suction.

Additionally, during the operation of the disclosed automatic pressure-relieving apparatus, air can enter the cannular portion 153 of the pipework 15 rapidly through the upper opening 151. Subsequently, when the sealing portion 221A that is pressing against the lower opening 152 encounters the pushing force coming along with the entered air, the elastic portion 221B provided at the lower end of the sealing portion 221A can be compressed downward so as to allow air to enter the oil reservoir 111 of the cylinder 11, and the communication between air in the cylinder 11 and air in the exterior can be accomplished.

As a conclusion, by implementing the control device to drive 3 the first and second rods 21, 22, the disclosed subject matter is capable of automatically releasing the air pressure that remains in the suction pump. Thereby, the disclosed subject matter can prevent oil from overflowing caused by oil continuously entering the cylinder and in turn avoiding the problem of components getting damaged by overflowed oil. Meantime, a user can be informed that the cylinder 11 is filled with oil when the automatic pressure-relieving operation begins.

Certainly, there may be still many examples of the present invention with merely variations in details. Please refer to FIG. 7 for a second embodiment of the present invention. It can be seen in the drawing that the relieving device is a piston tube 14 with its two opposite ends respectively fastened to the cap 12 and the bottom of the cylinder 11, and with the inner space thereof in communication with the air channel 121 of the cap 12. The control device 4 comprises a float 41 and an extending piece 42, wherein the float 41 is positioned around the periphery of the piston tube 14 in the manner that the float 41 is movable with respect to the piston 14 along the axial direction thereof, and the extending piece 42 extends from the bottom of the second rod 22 toward the float 41. Thereby, when the float 41 is lifted by the liquid, the extending piece 42 is pressed upward and in turn drives the first and second rods 21, 22 to move upward.

The above-discussed second embodiment is provided for illustrating an alternative form of the control device of the present invention. Similar to the former embodiment, the present embodiment also utilizes the oil contained in the pump to lift the float 41. Distinctively, the control device 4 of the present embodiment has the one-piece extending piece 42 that can be indirectly lifted to drive the first and second rods 21, 22 to move upward, so as to achieve the purpose of pressure relief through the upper opening 151 of the pipework 15.

Certainly, there may be still many examples of the present invention with merely variations in details. Please refer to FIG. 8 for another embodiment of the present invention. It can be seen in the drawing that the control device is a float 5, which is dissimilar to the control devices of the former embodiments. In the present embodiment, when the float 5 is lifted by the oil filled in the pump, it comes to push the first and second rods 21, 22 upward directly so as to achieve the purpose of pressure relief through the upper opening 151 of the pipework 15.

Foresaid variations of the disclosed subject matter can all accomplish the objective of the present invention and a manufacturer may distinguish its products into several attributes on the basis of the buoyancy of the floats. Hence, it is further proof that the present invention can be realized in numerous ways.

Figure 9:
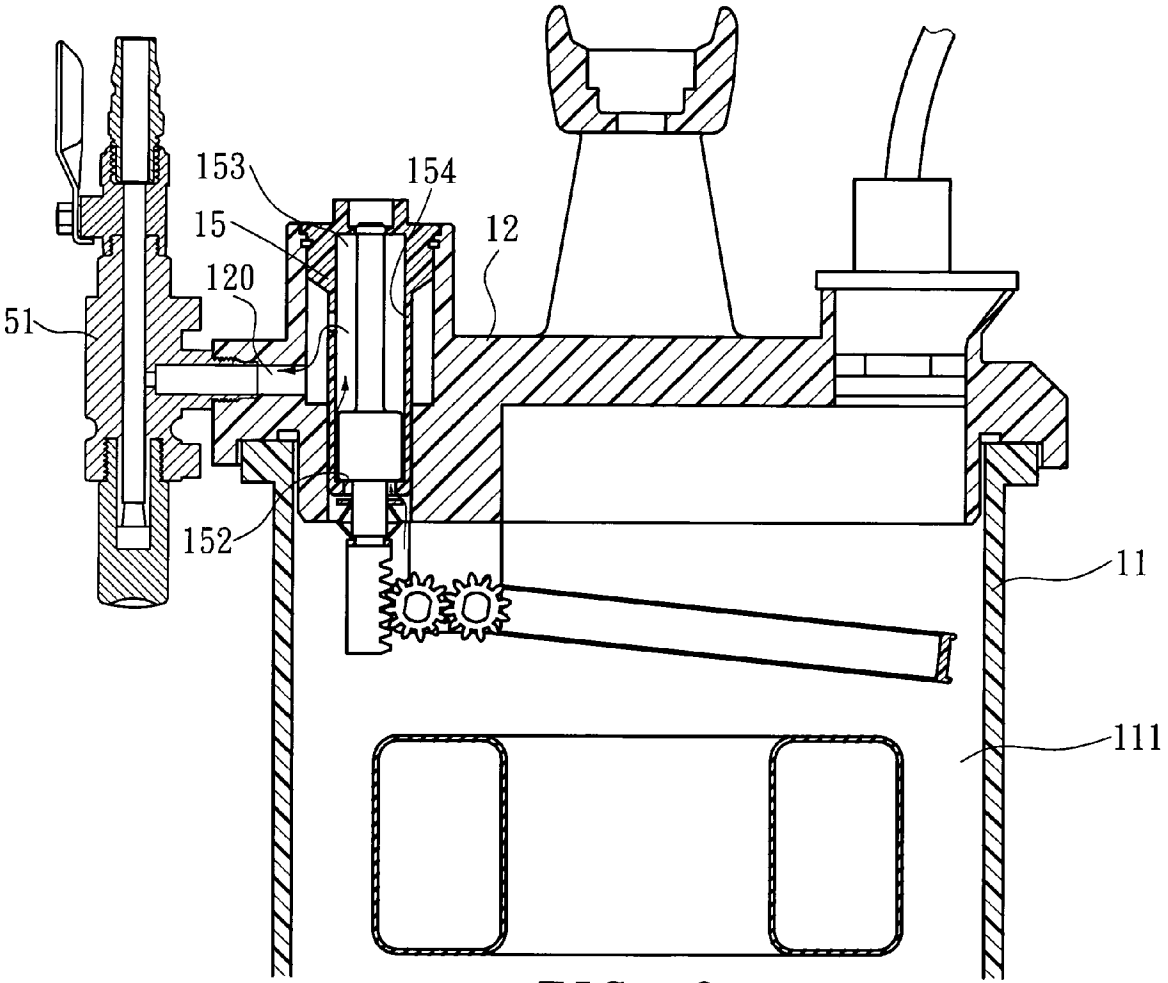
FIG. 9 is an applied drawing of the present invention showing disclosed subject matter embodied with a vacuum generator.
Figure 10:
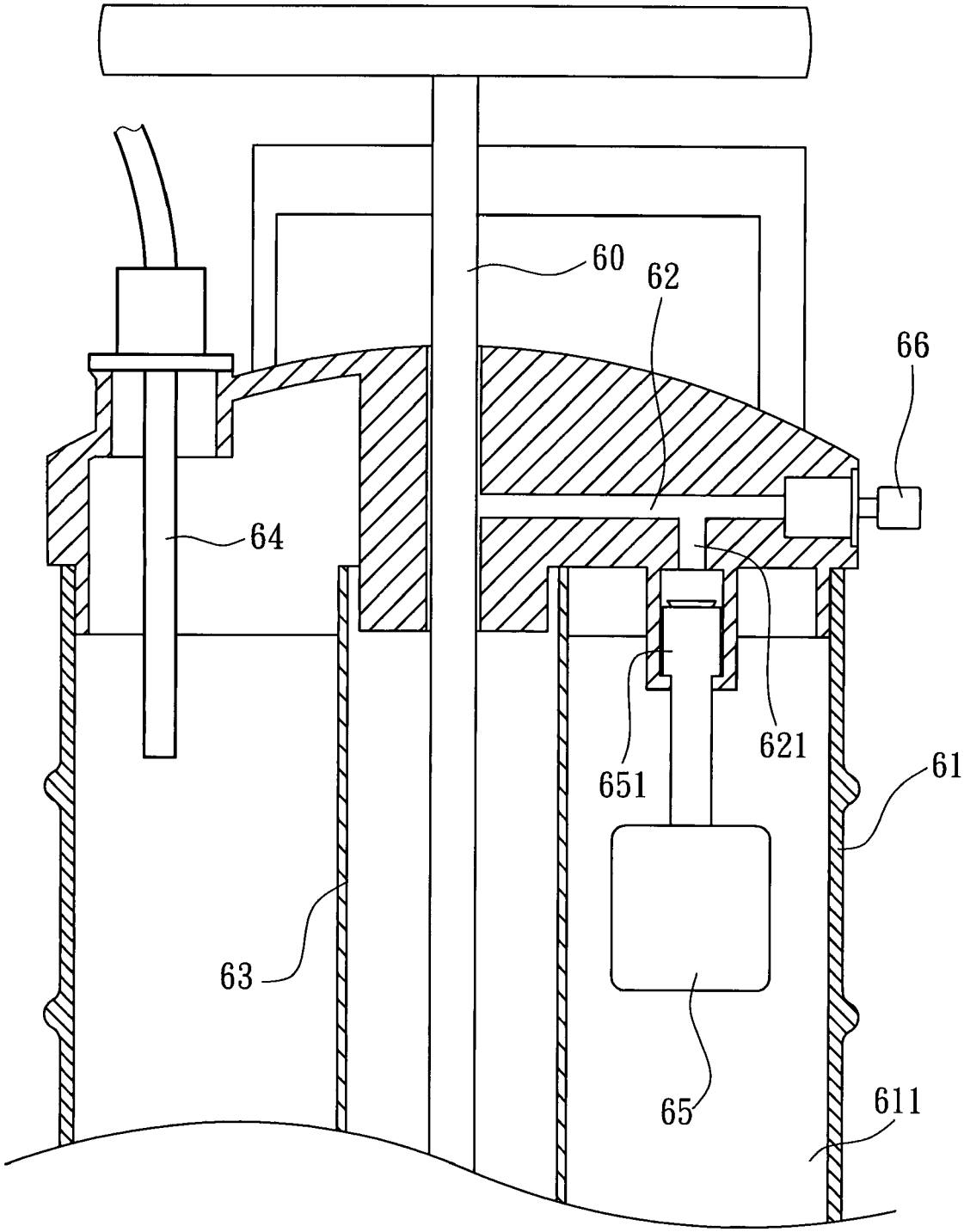
FIG. 10 PRIOR ART
FIG. 10 is a partially cross sectional view of a conventional suction pump.

Furthermore, please refer to FIG. 9. It can be seen in the drawing that the relieving device of the present invention may be also embodied with a vacuum generator 51. The vacuum generator 51 is situated at the side of the cap 12 and, according to the present embodiment, an air channel 120 of the cap 12 is transversely communicated with the exterior and in communication with the passage 123. Additionally, the vacuum generator 51 is connected with the air channel 120 at the point where the air channel 120 is communicated with the exterior.

In the case that the present embodiment is used in conjunction with an air compressor (not shown), air in the oil reservoir 111 can be exhausted by way of the lower opening 152 of the pipework 15, the cannular portion 153, the venthole 154 and the air channel 120 successively, so that external oil can be drawn in. When the oil reservoir 111 is filled with drawn oil, the relieving device of the present invention can similarly conduct pressure-relieving operation as previously discussed.

Thus, the relieving device of the present invention can alternatively collaborate with a piston to empty air or with a vacuum generator to exhaust air.

Although some particular embodiments of the invention have been described in details for purposes of illustration, it will be understood by one of ordinary skill in the art that numerous variations will be possible to the disclosed embodiments without going outside the scope of the invention as disclosed in the claims.

What is claimed is:

1. A suction pump having an automatic pressure-relieving apparatus comprising:

a cylinder having an oil reservoir arranged therein and a cap positioned on the top thereof wherein the cap includes an air channel;

a relieving device, which is connected to the cap and in communication with the air channel;

a pipework, which is positioned in the cap and has a upper opening at the top end thereof adjacent to the exterior, a lower opening at the bottom end thereof adjacent to the oil reservoir, a cannular portion defined between the upper and lower openings, and a venthole provided at the periphery thereof, whereby, the oil reservoir can be communicated with the relieving device through the lower opening, the cannular portion, the venthole and the air channel successively;

a first rod settled in the cannular portion of the pipework that can move downward from the exterior to detachably seal the upper opening of the pipework;

a second rod pierced through the lower opening of the pipework, and the top end of the second rod is positioned under the first rod in the cannular portion, while the lower end of the second rod is positioned under the lower opening of the pipework; a sealing component is arranged at the periphery of the second rod positioned under the lower opening for moving upward and detachably sealing the lower opening of the pipework; and a control device provided in the oil reservoir and approximately connected to the bottom of the second rod for controlling the upward and downward movements of the first and second rods.

2. The suction pump having an automatic pressure-relieving apparatus of claim 1, wherein the control device comprises a float, a driving member, a shaft, a connector, a driving gear and a driven gear, wherein the float is settled in the oil reservoir; the driving member is deposited above the float; the driving member is fastened to the shaft on one of its sides, while the opposite side thereof is facing one side of the float; the shaft is pierced through the driving gear; the driving gear is coupled and engaged with the driven gear; the driving and driven gears are pivotally fastened to the connector; the connector is attached to the cap on one side; and the second rod comprises a rack provided adjacent to the bottom thereof wherein the rack is positioned under the sealing component for being engaged with the driven gear.

3. The suction pump having an automatic pressure-relieving apparatus of claim 2, wherein the relieving device is a piston tube having two opposite ends respectively fastened to the cap and a bottom of the cylinder, and with the inner space thereof in communication with the air channel of the cap; the float is positioned around the periphery of the piston tube; the driving member is formed in a U-shape to embrace the opposite sides of the piston tube and be fastened to the two opposite ends of the shaft with the driving member's one side corresponding to the opening of the U shape.

4. The suction pump having an automatic pressure-relieving apparatus of claim 3, wherein the piston tube encloses a pullrod and a piston, in which the piston is positioned at one end of the pullrod while the opposite end of the pull rod is extending beyond the cap; a one-way valve is situated within the piston tube at the central bottom of the cylinder; and an oil inlet is arranged on the cap for the passage of oil.

5. The suction pump having an automatic pressure-relieving apparatus of claim 1, wherein the first rod further comprises an upper sealing ring arranged around the top periphery thereof, whereby the first rod can detachably seal the upper opening of the pipework.

6. The suction pump having an automatic pressure-relieving apparatus of claim 1, wherein the sealing component comprises a sealing portion and an elastic portion, in which the bottom of the elastic portion closely surrounds the periphery of the second rod and the sealing portion is situated on the elastic portion, wherein the sealing portion is deposited adjacent to the lower opening and can move up and down by virtue of the variation of the elastic portion.

7. The suction pump having an automatic pressure-relieving apparatus of claim 1, wherein the cap includes a passage that communicates the oil reservoir with the exterior, in which the passage is in communication with the air channel and the pipework is positioned in the passage.

8. The suction pump having an automatic pressure-relieving apparatus of claim 1, wherein the top of the second rod and the bottom of the first rod are coaxially coupled.

9. The suction pump having an automatic pressure-relieving apparatus of claim 1, wherein the relieving device is a piston tube having two opposite ends respectively fastened to the cap and the bottom of the cylinder, and with the inner space thereof in communication with the air channel of the cap, wherein the control device comprises a float and an extending piece, and the float is positioned around the periphery of the piston tube, while the extending piece extends from the bottom of the second rod toward the float, whereby, when the float is lifted, the extending piece is pushed upward and in turn drives the first and second rods to move upward.

10. The suction pump having an automatic pressure-relieving apparatus of claim 1, wherein the control device comprises a float.

11. The suction pump having an automatic pressure-relieving apparatus of claim 1, wherein the cylinder further includes a base at its bottom.

12. The suction pump having an automatic pressure-relieving apparatus of claim 1, wherein the relieving device is a vacuum generator, and is connected with the air channel at a point where the air channel can communicate with the exterior.

* * * * *